US006619923B2

(12) United States Patent
Chien

(10) Patent No.: US 6,619,923 B2
(45) Date of Patent: Sep. 16, 2003

(54) INTEGRATED 3-D BLADE STRUCTURE

(75) Inventor: Huan-Jan Chien, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 127 days.

(21) Appl. No.: 09/725,191

(22) Filed: Nov. 29, 2000

(65) Prior Publication Data

US 2002/0064460 A1 May 30, 2002

(51) Int. Cl.[7] ..... F04D 29/24; F04D 29/30

(52) U.S. Cl. ..... 416/186 R; 416/183; 416/188; 416/241 A

(58) Field of Search ..... 416/185, 186 R, 416/223 B, 183, 188, 213 A, DIG. 3, 241 A

(56) References Cited

U.S. PATENT DOCUMENTS 629,121 A * 7/1899 Bicalky ..... 416/186 R
6,033,183 A * 3/2000 Genster ..... 416/186 R

FOREIGN PATENT DOCUMENTS

JP 58-133498 A * 8/1983 ..... 416/186 R
SU 423944 A * 9/1974 ..... 416/186 R
SU 1267058 A1 * 10/1986 ..... 416/DIG. 3

* cited by examiner

*Primary Examiner*—Christopher Verdier
(74) *Attorney, Agent, or Firm*—Troxell Law Office PLLC

(57) ABSTRACT

An integrated 3-D blade structure which consists of at least two integrated pieces made by one-time shaping. Each integrated piece has a plurality of shorter 3-D curved-face blades and the relative let-in structures. Via the let-in structures, it is easily to match with the at least two integrated pieces. Then, the plurality of shorter blades could be matched with adjacent blades, depending on different design, to form a complete 3-D curved-face blade, or keeping a little distance between the matching blades to become a "Multi-Row" blade structure. Originally, since the whole blade structure with complicate 3-D curved face has been divided into several shorter blades for manufacturing, they are made via plastic emergence with forming or wax forming. Therefore, not only the element amount is highly decreased, but also the cost for position and assembly of blades is going down. Furthermore, the goal to approach the "Multi-Row" diffuser and impeller made via plastic emergence with forming or wax forming could be successful.

4 Claims, 9 Drawing Sheets

INTEGRATED 3-D BLADE STRUCTURE

1. Field of the Invention

This invention relates to integrated blades with 3-D structure, especially the 3-D blades structure of centrifugal impellers or differs to pumps, blowers, etc.

2. Background of the Invention

Generally, the impellers and diffusers in pumps or blowers are 3-D and metal-plate blades. These blades are mostly used by high efficiency centrifugal pumps and have 3-D curved faces that can be changed according to the angles or loading distribution of fluid on impellers or diffusers runners. Such that, pumping efficiency will be improved.

Because of the 3-D curved faces of the blades, the figures of the curved faces will be hardly manufactured by using technologies of casting with pattern and plastic emergence with pattern draw. Therefore, generally, the present manufacturing method is to form blades integrally (e.g., a plurality of blades could be formed integrally), but this would be for 2-D curved blades only and not for perfect 3-D curved faces. Because simple blade angles do not match fluid angles and loading requirements, pump efficiency shall be reduced, and would only work with centrifugal pumps which are cheap and have low efficiency.

Prior art manufacturing technologies could make 3-D curved faces of blades. On the other hand, large amount of blades, complicated designs, to position details for 3-D impellers, etc., are the short points for prior art technologies. Thus, firstly, manufacturing blades piece by piece via wax is the only method for prior art method. Then, blades could be positioned in front of impellers and between back covers, and followed with pour for finishing casting. Alternatively, blades could be manufactured piece by piece via plastic emergence with forming and positioning. These blades could be individually placed before impellers and between back covers for a whole set of impeller. The processes for manufacturing impellers and diffusers via plastic emergence and casting, discussed above are very complicated and not economical.

Besides, for some specially designed pumps, such as focusing on pumping functions of de-swirl of diffuser runner, or promoting pumping efficiency, the prior art technologies are impellers or diffusers with "Multi-Row" structures. For example, the patent of Taiwan Publication Number 342425, U.S. Pat. Nos. 5,310,309, 4,877,370, 5,417,547, 5,516,263, 4,354,802, etc., are discussing "Multi-Row" blade structures for applications and approaches. Nevertheless, these prior art 3-D curved and "Multi-Row" blade structures made by punching metal-plate will be manufactured, positioned and assembled piece by piece, and this kind of structure will increase multiple blades. Therefore, the assembly is difficult and manufacturing cost could be high. Thus, such technology still needs some advanced skill.

SUMMARY OF THE INVENTION

The first object of the invention is to supply an integrated 3-D blade structure. Originally, the technology was to manufacture, position and assemble blades separately, but now, the processes can be coordinated with a few of integrated pieces such that, those few integrated blade pieces are positioned, assembled or further worked simultaneously. The advantages of the combination mentioned above are not only that each blade has a 3-D curved face and a high pumping efficiency, but also greatly decreases the difficulty of positioning assembling, and the cost of manufacturing.

The second object is to supply an integrated 3-D blade structure having a large amount of blades with a few pieces that can be formed by plastic emergence with forming or wax for the entire structure. The only way is to combine the few pieces and the "Multi-Row" blade structure can be assembled rapidly. The advantages of the combined technology are having nice 3-D curved face and high pumping efficiency for each blade and simplifying the processes of assembly and decreasing cost.

The preferred embodiment for the integrated 3-D blade structure of the invention includes at least two integrated pieces that are formed at one time. Each integrated piece has a plurality of blades with shorter 3-D curved faces and relative let-in structure. It is easily assembling at least two integrated pieces via the let-in structure, and the shorter blades can be adjacent relatively to form complete 3-D curved face depending on different design or keep a suitable distance in between to form a "Multi-Row" blade structure. Originally, a complete blade with complicate 3-D curved face could be divided to several shorter lengths for manufacturing, thus the blade could be assembled and formed by plastic emergence with forming or wax forming. Therefore, resulting in the amount of components being greatly decreased and the position and assembly of blades being more convenient and cost being reduced. Furthermore, the impeller and diffuser with "Multi-Row" can be made by plastic or casting.

For fully understanding this invention with features and content, the following examples with detail drawings will let you have further understanding for advantages and applications of this invention.

DETAILED DESCRIPTION OF THE PREFERRED EMBODIMENTS

The main feature is giving up the prior art method to manufacture centrifugal pumps and blowers via plastic or casting for impellers or diffusers, and firstly, the method of forming each blade individually, thus, to position, assemble and combine the whole impeller step by step. In contrast, this invention is to integrate two or more integrated pieces. Such pieces are divided plural pieces (more than six usually) for individually manufacturing as original. Thus, all we have to do is combine the two integrated pieces and position multiple blades for assembly or more work can be completed simultaneously. Furthermore, the impeller or diffuser with "Multi-Row Blades" structure could be developed. Each integrated piece has multiple shorter blades and 3-D curved face made by plastic emergence with forming or wax forming. After combining the two or more integrated pieces, the blades of the pieces can form a single blade with curved face, or the blades are not adjacent but the blade structure with multi-row still can be formed by them. This invention divides blades with 3-D curved faces to several different parts and figures out the difficulty of prior art technology for manufacturing. Hence, the possibility for plastic emergence with forming or wax forming to form blades with 3-D curved faces is created. Using this method and structure, the number of elements of the impeller or diffuser will be greatly decreased, and assembly of the blades being more convenient and cost being reduced. Further, the cost not only includes a mold, but also a clamping apparatus. The runner design for impeller or diffuser is more flexible with this invention, and plastic emergence with forming or casting for forming the impeller and diffuser with "Multi-Row Blades" can be reached.

Firstly, referring to FIG. 1A to FIG. 4, the impeller of the integrated 3-D blade structure with plastic or wax made is the preferred embodiment. For the preferred embodiment, the impeller with 3-D plastic or wax blades consists of a first integrated piece (called inner piece 1 for following) and a second integrated piece (called outer piece 2 for following). The two pieces are made of plastic emergence with forming or wax forming and have a plurality of individual blades. Also, this preferred embodiment divides the 3-D plastic or wax blades of the impeller into two parts, piece 1 and piece 2, for manufacturing. Also, the blades of the impeller could be divided three or more pieces.

Figure 1B:
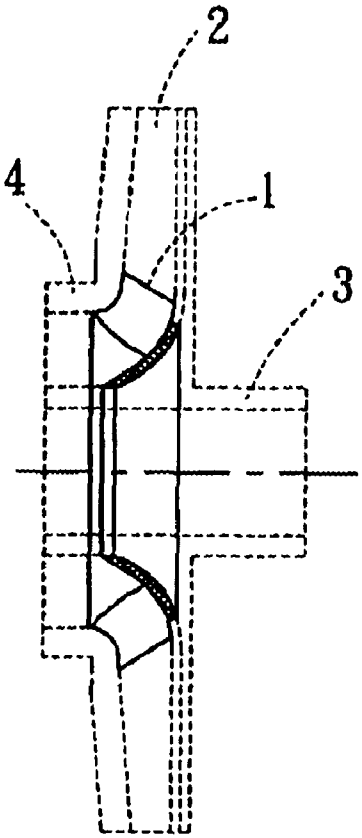
FIG. 1B is the sectional view of FIG. 1A (along line 91—91).
Figure 1A:
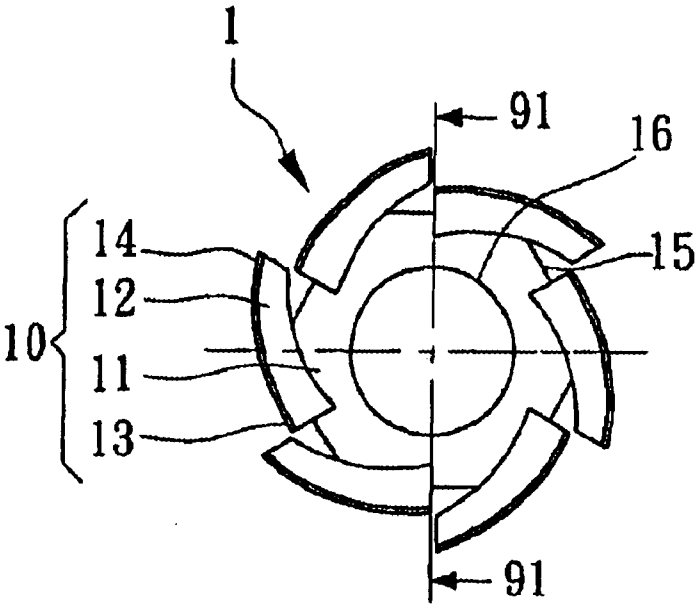
FIG. 1A is the front view of inner piece of preferred embodiment for this invention.

Please refer to FIG. 1A and FIG. 1B. The inner piece 1 is a hollow and disc shape, and there are some shorter 3-D inner blades 10 (about a half length of normal blade) with a radiating elongation. Each 3-D inner blade 10 has its own 3-D curved face and can be made by plastic emergence with forming or wax forming because of shorter length and no overlap of adjacent blades. From the closer inner end of each inner blade 10, the arrangement in order is inner base plate 11 and inner blade body 12. The central part of inner base plate 11 is a hub hole 16 going through the inner base plate 11 and the rim of inner base plate 11 is let-in edge 15. The let-in edge 15 for this preferred embodiment is a straight-line edge structure, but it could be other geometry structures. The inner leading edge 13 and the inner trailing edge 14 are defined as the two ends of inner blade body 12. Between inner blade body 12 and inner base plate 11 is an angle that is a 3-dimension structure.

Figure 2B:
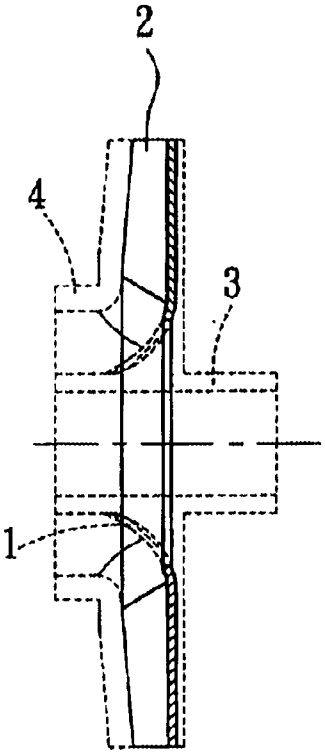
FIG. 2B is the sectional view of FIG. 2A (along line 92—92).
Figure 2A:
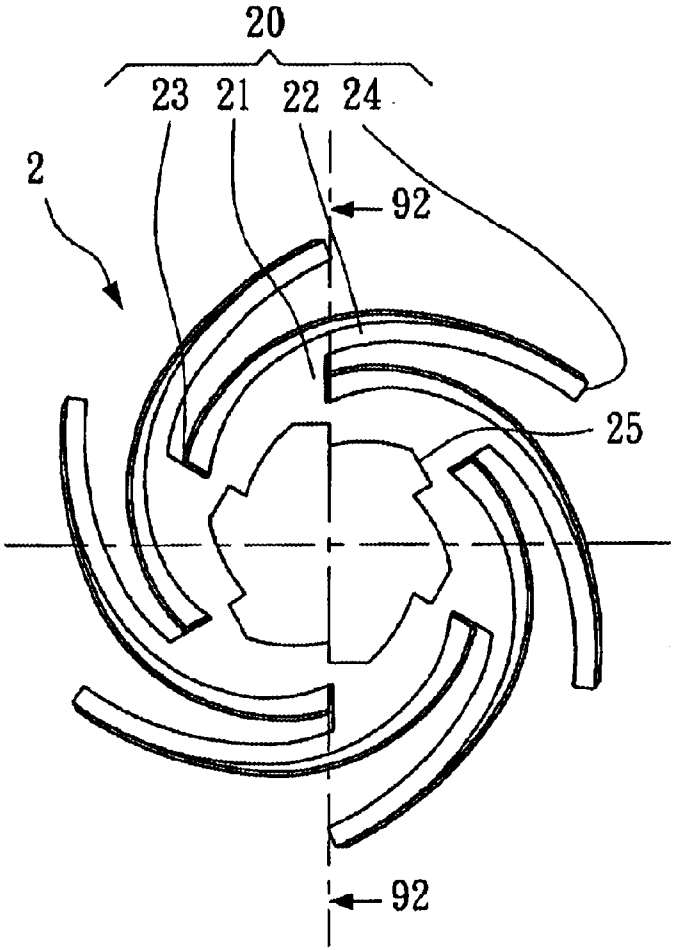
FIG. 2A is the front view of outer piece of preferred embodiment for the invention.
Figure 2C:
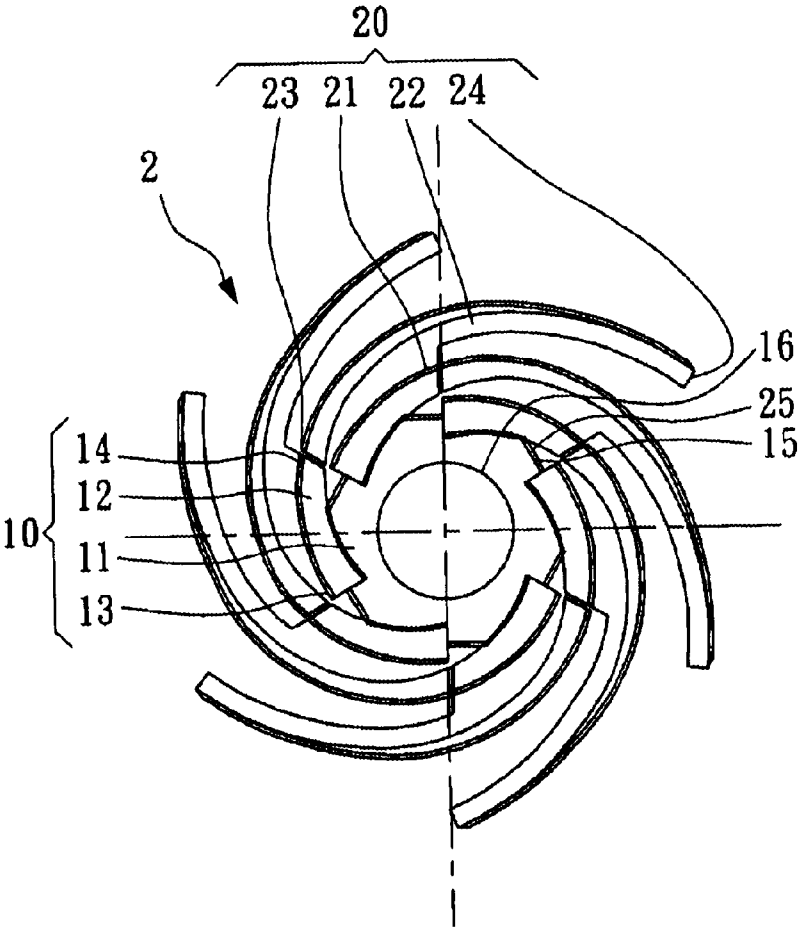
FIG. 2C is a front of an alternative construction of the propeller hub of the invention.

Referring to FIG. 2A, FIG. 2B, and FIG. 2C, outer piece 2 is a hollow and disc shape, and there are some 3-D outer blades 20 with a radiating elongation. From the closer inner end of each outer blade 20, the arrangement in order is outer base plate 21 and outer blade body 22. The central part of outer base plate 21 is a let-in hole 25 going through the outer base plate 21 and the shape of outer base plate 21 is dependent on let-in edge 15 for let-in and position. Between outer blade body 21 and outer base plate 21 is an angle that is a 3-dimension structure. The outer leading edge 23 and the outer trailing edge 24 are defined as the two ends of outer blade body 21.

Figures 3A, 3B, 3C:
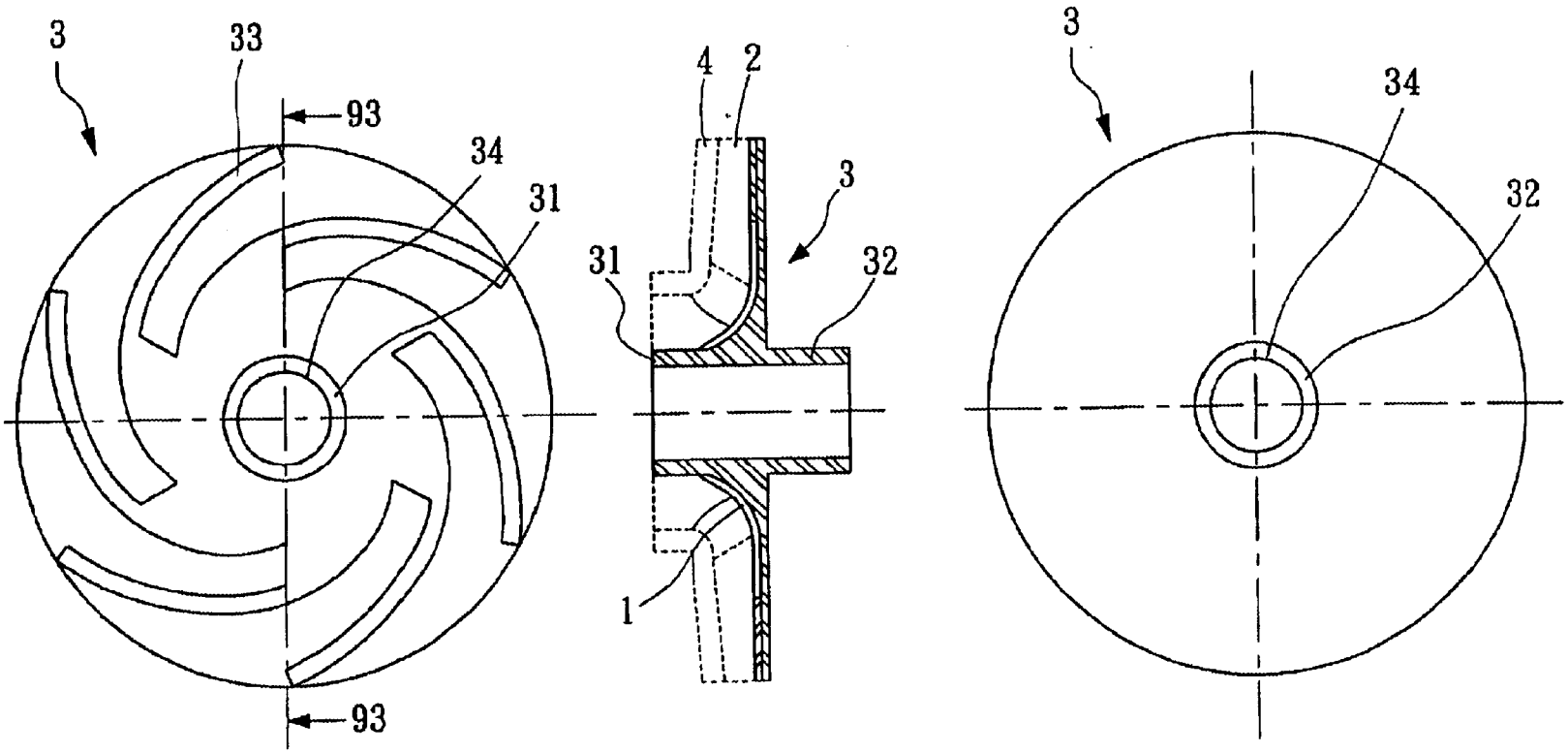
FIG. 3A is the front view of impeller hub center of preferred embodiment for this invention.
FIG. 3B is the sectional view of FIG. 3A (along line 93—93).
FIG. 3C is the rear view of FIG. 3A.

Referring to FIGS. 3A, 3B and 3C, it is a blade center hub body 3 and made by plastic emergence with forming and wax forming. The central part of the blade center hub body 3 is hub piercing 34 and several impeller blade grooves 33, which are a radiating elongation at the side of the blade center hub body 3. The central part is a hollow cylinder and on the left side of FIG. 3B forms a blade hub 31. On the other side, the center is a flat face and elongates towards the right side of FIG. 3B to form a hollow cylinder, thus the diffuser hub 32 is ready.

Figure 4:
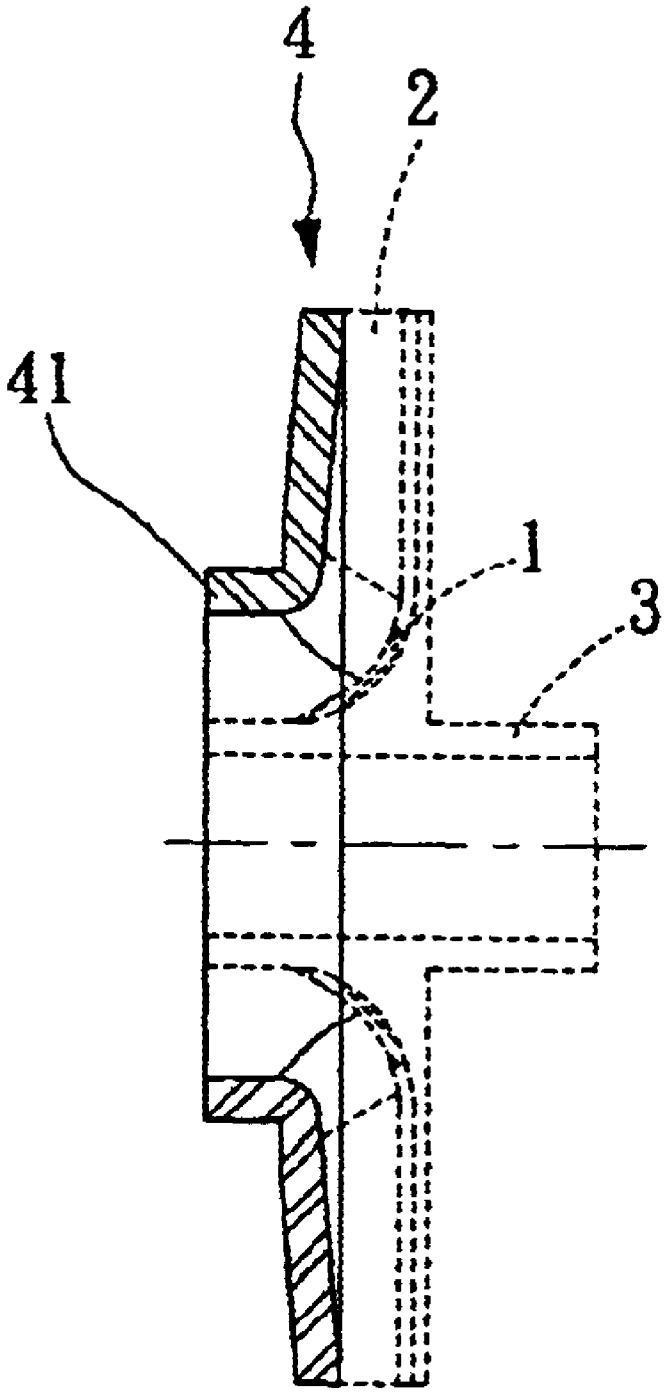
FIG. 4 is the sectional view of impeller front cover structure of preferred embodiment for this invention.

Referring to FIG. 4, it is a sectional view of structure of an impeller front cover 4. The impeller front cover 4 is made by plastic emergence with forming or wax forming and it is a hollow and bonnet shape structure. The top of bonnet is a hollow cylinder with suitable thickness; hence the fixing hub 41 is formed.

When let-in edge 15 of inner piece 1 matches with let-in hole 25 of outer piece 2, the two pieces 1 and 2 could be combined to form an integrated 3-D blade structure rapidly. The combination for inner piece 1 and outer piece 2 is through a hub hole 16, and blade hub 31 and outer blades 20 are set to impeller blade grooves 33 to become a whole body. After that, inner piece 1 and outer piece 2 are combined and positioned between impeller front cover 4 and blade center hub body 3, and therefore forming a complete impeller structure. Thereby easily and rapidly assembling complete impeller structure without any problem with positioning the blades.

For the preferred embodiment, the inner trailing edges 14 of inner blades 10 in inner piece 1 are matched relative and adjacent to outer leading edges 23 of outer blades 20 in outer piece 2 individually. Therefore, the complete blade structure has a nice 3-D curved face and the pumping efficiency can be improved. On the other hand, when assembling inner trailing edges 14 and outer leading edges 23 by keeping a little distance between them a "Multi-Row" blade structure will be formed. In the preferred embodiment, the number of inner blades 10 are equal to the number of outer blades 20, but different numbers for both can also be made.

Figures 5A, 5B, 5C:
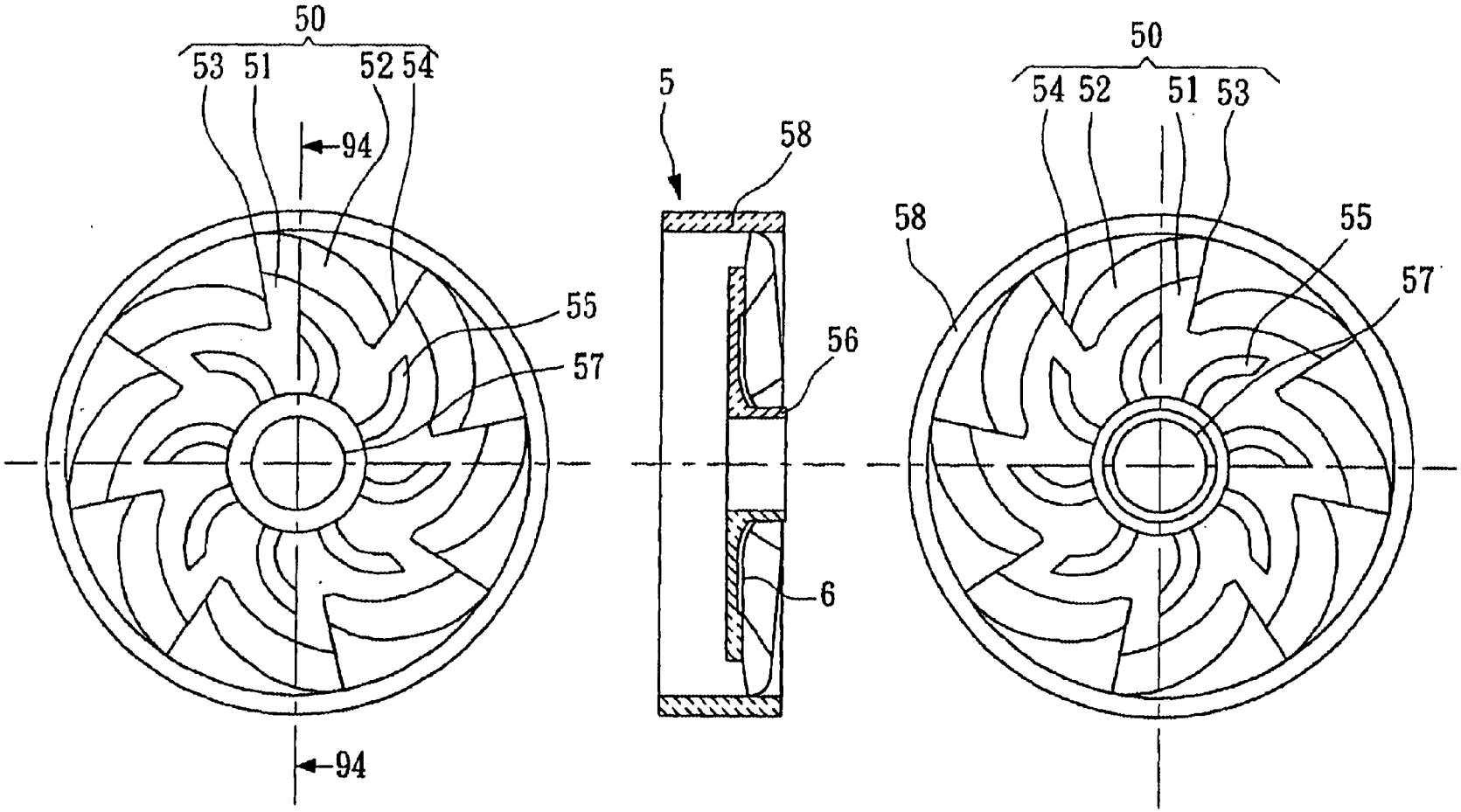
FIG. 5A is the front view of outer diffuser hub structure of preferred embodiment for this invention.
FIG. 5B is the sectional view of FIG. 5A (along line 95—95).
FIG. 5C is the rear view of FIG. 5A.

Referring to FIG. 5A and FIG. 5B, the preferred embodiment is an integrated 3-D impeller structure applied to diffuser made by plastic or wax. The 3-D blades of the diffuser in the preferred embodiment consist of a first integrated piece and a second integrated piece. The two integrated pieces are made via plastic emergence with forming or was forming, and have several diffuser blades. Although the 3-D diffuser blades are divided into two parts being an outer diffuser hub 5 and inner diffuser 6, three or more parts can also be made.

Referring to FIG. 5A, FIG. 5B and FIG. 5C, the outer ring hub 58 of the outer diffuser hub 5 is a ring figure structure and the outer ring hub 58 connects with 3-D outer diffuser blades 50 which are a radiating elongation. The arrangement of closer inner end of each outer diffuser blade 50 in order is an outer base plate 51 and outer diffuser blade body 52. There is a bulging cylinder arranged on central part of the outer base plate 51 and a diffuser hub hole 57 on the center is penetrating the outer diffuser hub 5. Thus, the outer hub 56 is formed and there are some radiating elongation inner diffuser grooves 55 from the outer hub 56. Between outer diffuser blades 50 and outer base plates 51 are suitable angles that are 3-D structures. The outer diffuser leading edges 53 and outer diffuser trailing edges 54 are defined at the two ends of outer base plate 51.

Figure 6B:
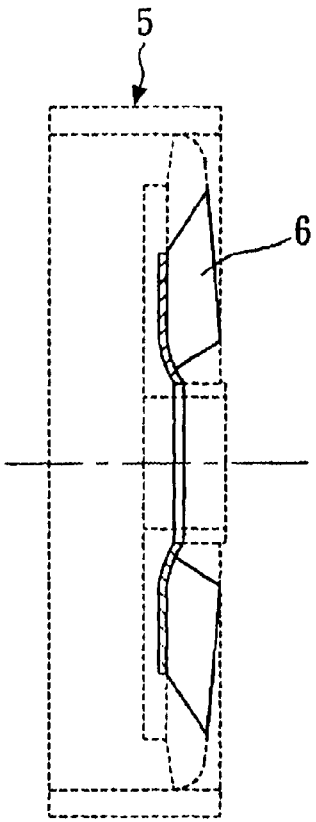
FIG. 6B is the sectional view of FIG. 6A (along line 94—94).
Figure 6A:
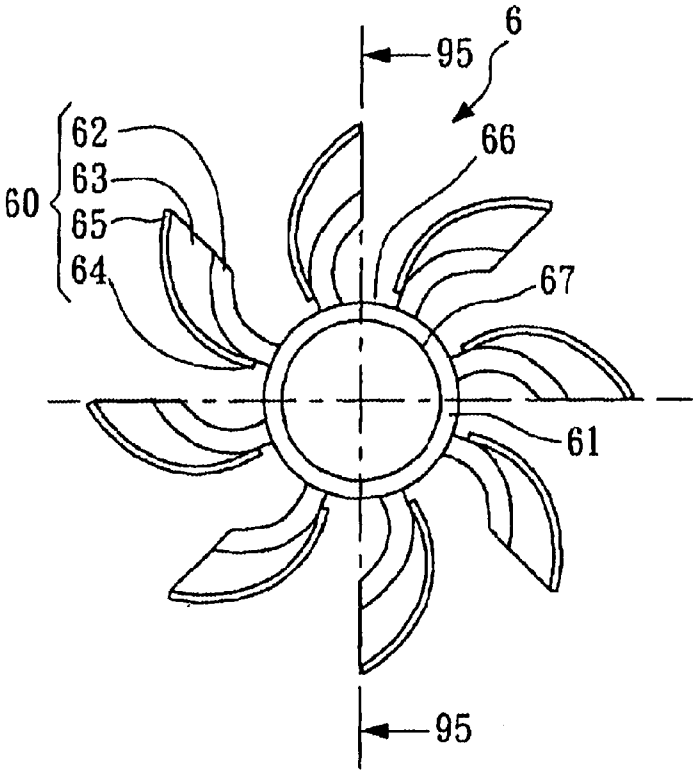
FIG. 6A is the front view of inner diffuser of preferred embodiment for this invention.
Figure 7:
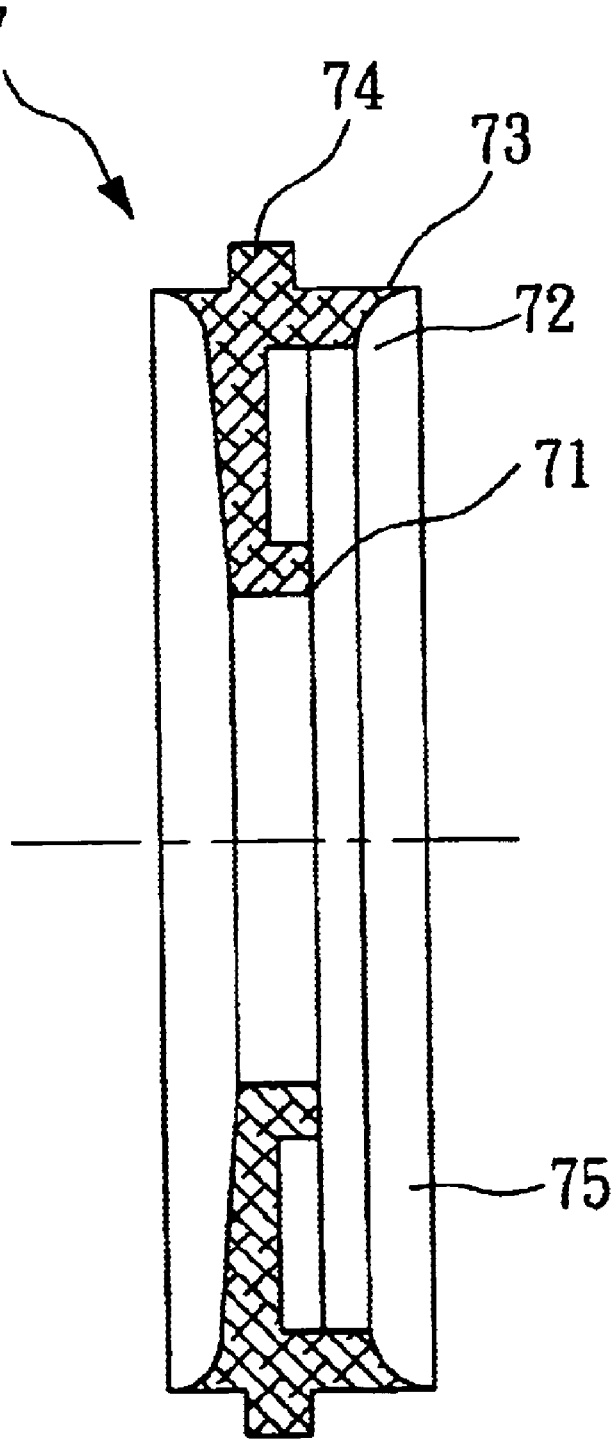
FIG. 7 is the sectional view of assembled hub structure of preferred embodiment for this invention.

As FIG. 6A and FIG. 6B show, the inner diffuser 6 is a disc shape with hollow structure, and there are several radiate elongation 3-D inner diffuser blades 60 arranged on the inner diffuser 6. The arrangement of closer and inner end of each inner diffuser blade 60 in order is an inner base plate 66, an inner diffuser bottom plate 62 and an inner diffuser body 63. The center of the inner base plate 66 is an inner hub hole 67 penetrating the inner diffuser 6 and the position of the inner hub hole 67 is opposite to the outer hub 56. Between inner diffuser bodies 63 and inner diffuser bottom plates 62 are suitable angles that are 3-D structures. The inner diffuser leading edge 64 and the inner diffuser trailing edge 65 are defined at the two ends of each inner diffuser body 63.

When assembling, combine and position the outer hub 56 of the outer diffuser hub 5 and the inner hub hole 67 of the inner diffuser 6, and match the inner diffuser bottom plate 62 with the inner diffuser groove 55 of the outer base plate 51, such that, the integrated 3-D blade structure is formed. Following the above assembling process, assembling a complete diffuser structure is easy and rapid, and there is not the problem of plural diffuser blades to position and assemble.

When outer diffuser hub 5 is combined with inner diffuser 6 in the preferred embodiment, the outer diffuser trailing edges 54 of outer diffuser blades 50 are individually relative to the inner diffuser leading edges 64 of inner diffuser blades 60. Each pair of outer diffuser trailing edge 54 and inner diffuser leading edge 64 are positioned with a little distance between them on radius or circumference direction in order to form a "Multi-Row" blade structure. On the other hand, the design can be changed such that combining outer diffuser trailing edges 54 and inner diffuser leading edges 64 forms plural one-body blades for the diffuser structure. Although the number of outer diffuser blades 50 is same as the number of inner diffuser blades 60, different numbers of each also can be made.

As FIG. 6 showing, it is a binding hub 7 made by plastic emergence with forming or wax forming and multiple layers with hollow ring shape structure. From center, the arrangement in order is a fixing hub hole 71, a placing hole 72 and an outer ring 73. On the outside of the outer ring 73 is a flange ring 74 for matching binding hub 7 with outer diffuser hub 5. Hence, a room 75 is formed between them.

Figure 8:
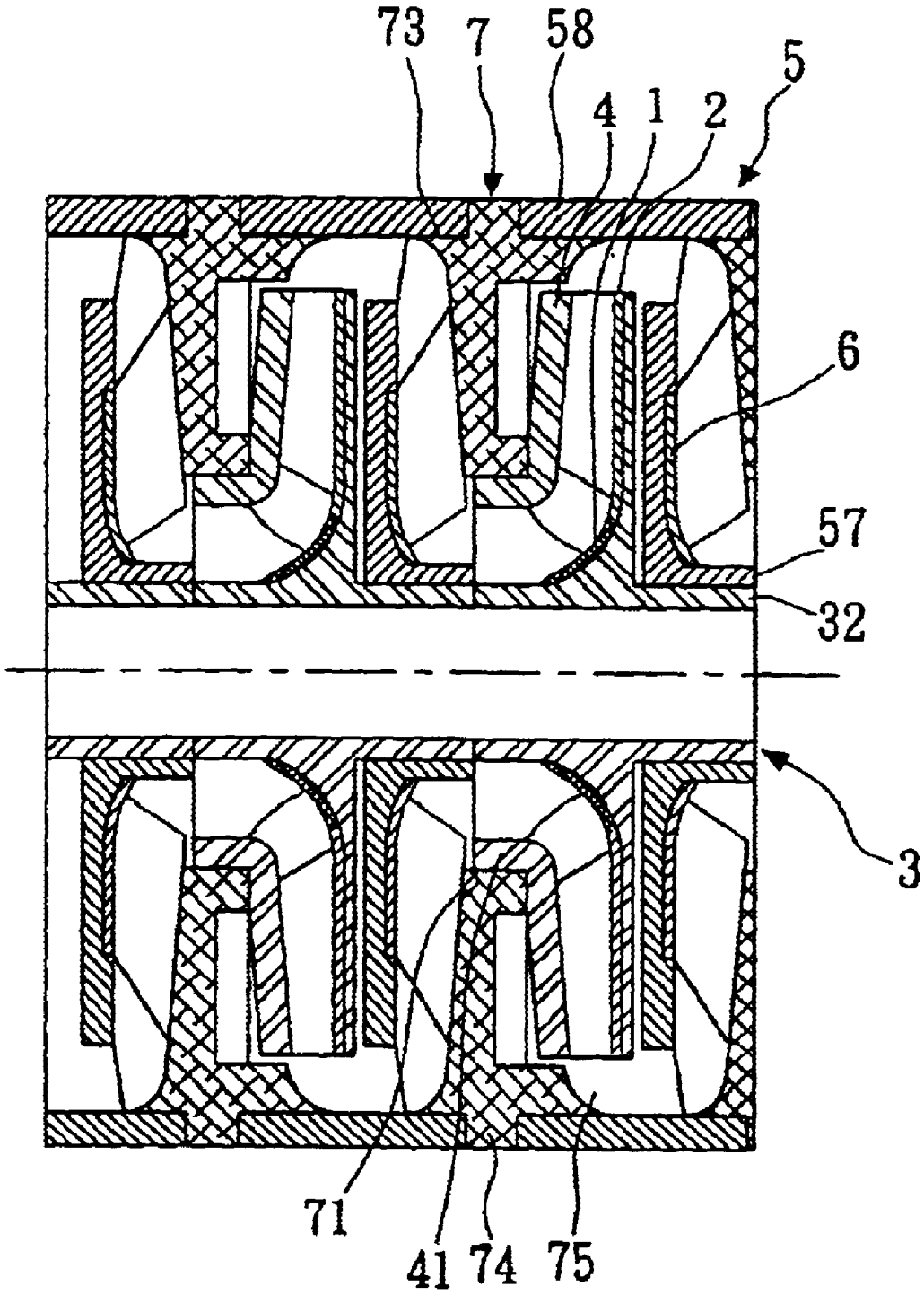
FIG. 8 is the sectional view of elements relative positions assembly of preferred embodiment for this invention.

As FIG. 8 shows, it is the sectional view of elements in relative positions of assembly in the preferred embodiment of this invention. The binding hub 7 is combined with outer ring hub 58 of outer diffuser hub 5 via outer ring 73, and flange ring 74 is matching with outer diffuser hub 5, therefore, one side is left room 75 because of matching with diffuser hub 5 and the other side is matched with another diffuser hub 5. The following combination will have no limitation for an extension combination and it can be suitable for different outputs.

The room 75 is just making impeller to let-in. Thus, in the combination fixing hub hole 71 is matched with fixing hub 41 of impeller front cover 4, and blade center hub body 3 is penetrating the diffuser hub hole 57 of outer diffuser hub 5, thus the purposes to position and combine are reached.

As the preferred embodiment of the invention, elements are made via plastic emergence with forming or wax forming, and therefore to install them depending on design. By using plastic assembly is easy and the elements are combined tightly to reach the expected efficiency. When casting, combine the wax forms of plural pieces and the complete wax form can be finished. Pouring the complete wax form could decrease the large amount of elements of the prior art technology.

It may thus be seen that the objects of the present invention set forth herein, as well as those made apparent from the foregoing description, are efficiently attained. While the preferred embodiments of the invention have been set forth for purpose of disclosure, modifications of the disclosed embodiments of the invention as well as other embodiments thereof may occur to those skilled in the art. Accordingly, the appended claims are intended to cover all embodiments, which do not depart from the spirit and scope of the invention.

What is claimed is:

1. An integrated 3-dimensional blade structure comprising:

a) an inner piece having an inner base plate and a plurality of radially elongated inner blades connected to the inner base plate, the inner base plate having a hub hole through a center and a let-in edge on an outer circumference thereof, each of the plurality of inner blades having an inner leading edge and an inner trailing edge at opposing ends thereof, a 3-dimensional angle is formed between the inner base plate and the plurality of inner blades;

b) an outer piece having an outer base plate and a plurality of radially elongated outer blades connected to the outer base plate, the outer base plate having a let-in hole through a center thereof, each of the plurality of outer blades having an outer leading edge and an outer trailing edge at opposing ends thereof, the let-in hole being shaped to mate with the let-in edge of the inner piece and the let-in edge of the inner piece being engaged therein, a 3-dimensional angle is formed between the outer base plate and the plurality of outer blades;

c) a blade center hub body having a hollow cylinder through a center and a plurality of radially elongated impeller blade grooves on a first side thereof, the hollow cylinder having a hub through a center thereof, a blade hub extending from the first side of the blade center body, and a diffuser hub extending from a second side of the blade center body; and d) an impeller front cover having a hollow cylindrical fixing hub through a center thereof, wherein the combination of the inner piece and outer piece is positioned between the impeller front cover and the blade center hub body to form a complete blade structure.

2. The integrated 3-dimensional blade structure according to claim 1, wherein the inner trailing edges of the plurality of inner blades of the inner piece are aligned with the outer leading edges of the plurality of outer blades of the outer piece.

3. The integrated 3-dimensional blade structure according to claim 1, wherein the inner piece is oriented with the outer piece, such that the inner trailing edges of the plurality of inner blades of the inner piece are offset from the outer leading edges of the plurality of outer blades of the outer piece.

4. The integrated 3-dimensional blade structure according to claim 1, wherein the let-in edge is a straight-line edge structure.

* * * * *